US009090417B2

(12) United States Patent
Takamori

(10) Patent No.: US 9,090,417 B2
(45) Date of Patent: Jul. 28, 2015

(54) MEDIUM FEEDING APPARATUS

(71) Applicant: PFU Limited, Kahoku-shi, Ishikawa (JP)

(72) Inventor: Masaya Takamori, Ishikawa (JP)

(73) Assignee: PFU LIMITED, Ishikawa (JP)

( * ) Notice: Subject to any disclaimer, the term of this patent is extended or adjusted under 35 U.S.C. 154(b) by 0 days.

(21) Appl. No.: 14/083,180

(22) Filed: Nov. 18, 2013

(65) Prior Publication Data

US 2014/0284878 A1 Sep. 25, 2014

(30) Foreign Application Priority Data

Mar. 19, 2013 (JP) ..... 2013-056655

(51) Int. Cl.

*B65H 5/06* (2006.01)
*B65H 1/14* (2006.01)
*B65H 3/06* (2006.01)
*B65H 3/52* (2006.01)

(52) U.S. Cl.

CPC ..... *B65H 5/062* (2013.01); *B65H 1/14* (2013.01); *B65H 3/06* (2013.01); *B65H 3/5261* (2013.01); *B65H 2402/441* (2013.01); *B65H 2403/53* (2013.01); *B65H 2404/1442* (2013.01); *B65H 2551/15* (2013.01); *B65H 2801/06* (2013.01); *B65H 2801/39* (2013.01)

(58) Field of Classification Search

CPC ..... B65H 2511/224; B65H 2404/144; B65H 2404/1441; B65H 2404/1442
USPC ..... 271/273, 274; 399/124, 125
See application file for complete search history.

(56) References Cited

U.S. PATENT DOCUMENTS

| | | | | | |
|---|---|---|---|---|---|
| 5,765,825 | A * | 6/1998 | Watase | 271/9.13 |
| 5,802,426 | A * | 9/1998 | Miyazaki et al. | 399/113 |
| 6,042,112 | A * | 3/2000 | Izumi | 271/273 |
| 6,598,870 | B2 * | 7/2003 | Hanano | 271/138 |
| 6,829,453 | B2 * | 12/2004 | Kouzu | 399/124 |
| 7,267,338 | B2 | 9/2007 | Kuwata et al. | |
| 7,448,619 | B2 | 11/2008 | Kuwata et al. | |
| 8,419,006 | B2 * | 4/2013 | Imura | 271/3.14 |
| 8,521,064 | B2 * | 8/2013 | Yamauchi | 399/121 |
| 2003/0031480 | A1 * | 2/2003 | Miura | 399/124 |
| 2007/0154238 | A1 * | 7/2007 | Yokoi | 399/124 |

(Continued)

FOREIGN PATENT DOCUMENTS

| | | | | |
|---|---|---|---|---|
| JP | 02138072 | A * | 5/1990 | B65H 29/60 |
| JP | 2003-302876 | A | 10/2003 | |

(Continued)

*Primary Examiner* — Jeremy R Severson
(74) *Attorney, Agent, or Firm* — McDermott Will & Emery LLP

(57) ABSTRACT

A medium feeding apparatus includes a rotating unit, a fixed unit, a separating roller and a conveying roller that are installed in the rotating unit and convey a medium present on a conveying path in a conveying direction, a braking roller and a driven roller that are installed in the fixed unit and come into press contact with the separating roller and the conveying roller on the conveying path, respectively, a lock arm that is installed in the rotating unit, a lock shaft that is installed in the fixed unit and keeps the position of the rotating unit relative to the fixed unit by locking the lock arm, and a position changing unit (a link member and a rotating member) that changes the position of the rotating unit relative to the fixed unit by the movement of the lock shaft in a up-and-down direction.

5 Claims, 16 Drawing Sheets

(56) References Cited

U.S. PATENT DOCUMENTS

2011/0293326 A1* 12/2011 Tanabe et al. ..... 399/124
2014/0140727 A1* 5/2014 Shimoi ..... 399/121

FOREIGN PATENT DOCUMENTS

JP 2005-010575 A 1/2005
JP 2007-053532 A 3/2007

* cited by examiner

MEDIUM FEEDING APPARATUS

CROSS-REFERENCE TO RELATED APPLICATION

This application is based upon and claims the benefit of priority from Japanese Patent Application No. 2013-056655, filed on Mar. 19, 2013, the entire contents of which are incorporated herein by reference.

BACKGROUND OF THE INVENTION

1. Field of the Invention

The present invention relates to a medium feeding apparatus.

2. Description of the Related Art

When a conveyance error, such as a jam or a double-feed, occurs in a medium feeding apparatus that separates and feeds media one by one from a plurality of stacked sheet-like media, recovery work for recovering the error is performed by an operator. In the recovery work, the operator opens a cover of a portion where the error occurs, removes a medium causing the error from the apparatus, closes the cover, and sets a medium again. In the past, techniques that automatically open a cover of a portion where an error occurs at the time of the occurrence of the conveyance error have been known to improve the efficiency of this recovery work (for example, see Japanese Laid-open Patent Publication No. 2003-302876 and Japanese Laid-open Patent Publication No. 2007-53532).

A medium feeding apparatus in the related art had room for further improvement in terms of the efficiency of recovery work at the time of the occurrence of a conveyance error.

SUMMARY OF THE INVENTION

It is an object of the present invention to at least partially solve the problems in the conventional technology.

According to an aspect of the present invention, a medium feeding apparatus includes: a first member; a second member; a first conveying unit that is installed on the first member and conveys a medium present on a conveying path in a conveying direction; a second conveying unit that is installed on the second member and comes into press contact with the first conveying unit on the conveying path; a locking member that is installed on the first member; a receiving member that is installed on the second member and keeps a position of the first member relative to the second member by locking the locking member; and a position changing unit that changes the position of the first member relative to the second member by moving any one of the locking member and the receiving member in a predetermined direction.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Figure 1:
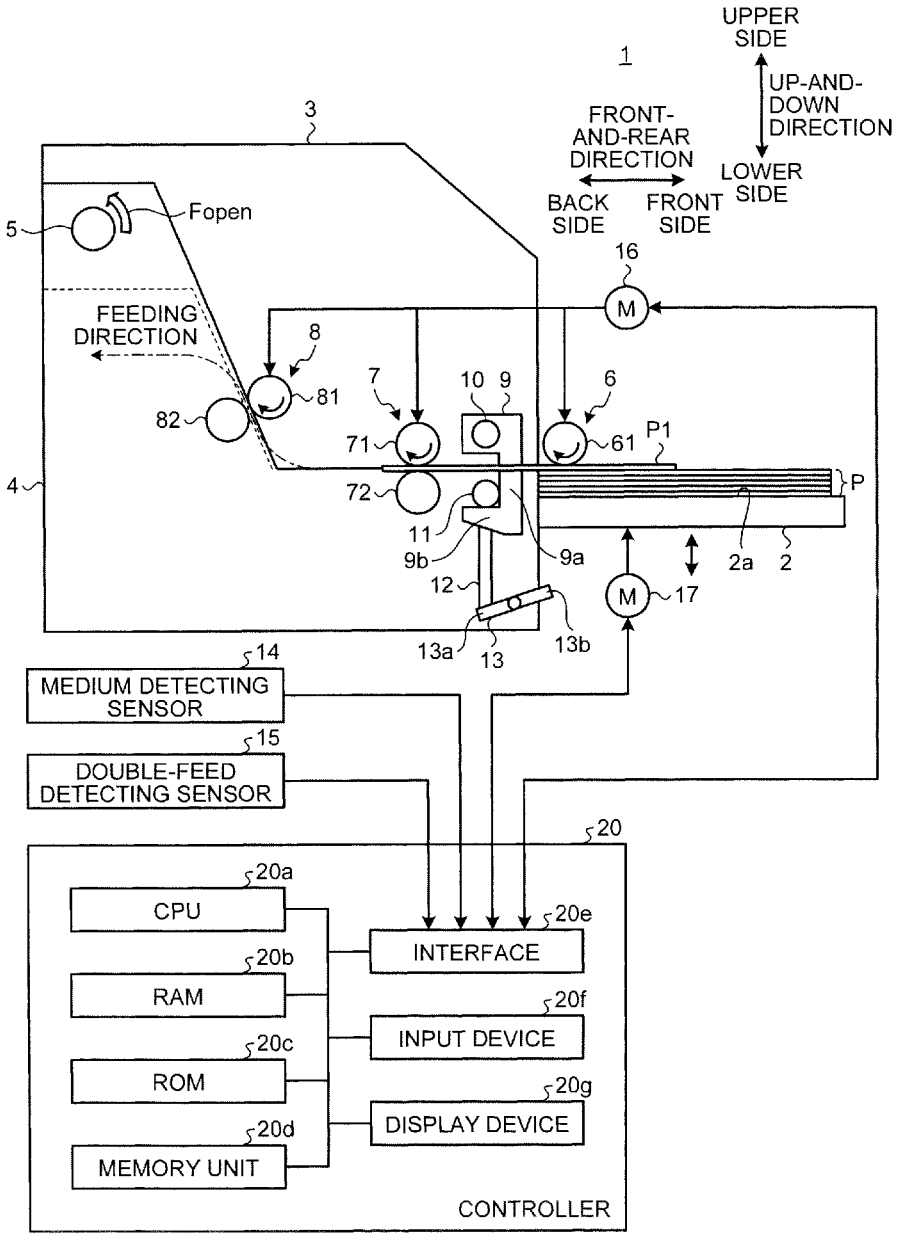
FIG. 1 is a diagram for explaining the hardware structure of a medium feeding apparatus according to a first embodiment of the invention.

A medium feeding apparatus according to embodiments of the invention will be explained below with reference to the drawings. Meanwhile, the same portions or corresponding portions are denoted by the same reference numerals, and the explanation thereof will not be repeated.

First Embodiment

A first embodiment will be explained with reference to FIGS. 1 to 7. First, the structure of a medium feeding apparatus according to the first embodiment will be explained with reference to FIGS. 1 to 5. FIG. 1 is a diagram for explaining the hardware structure of the medium feeding apparatus according to the first embodiment of the invention.

As shown in FIG. 1, the medium feeding apparatus 1 according to this embodiment is an apparatus that separates and feeds media P1 to be conveyed one by one from a plurality of media P stacked on a hopper 2 (medium loading unit). The medium feeding apparatus 1 is applied to an automatic document feeder (ADF) that is mounted on, for example, image readers, such as an image scanner, a copy machine, a facsimile, and a character recognition device, or an image forming apparatus such as a printer. Media P and P1 include, for example, sheet-like objects to be read, such as a document and a business card, and sheet-like recording media, such as a print sheet and a sheet.

Meanwhile, in the following explanation, an up-and-down direction and a left-and-right direction in FIG. 1 are explained as an up-and-down direction and a front-and-rear direction of the medium feeding apparatus 1; the upper side, the lower side, the right side, and the left side in FIG. 1 are explained as the upper side, the lower side, the front side, and the back side of the medium feeding apparatus 1, respectively; and a vertical direction, that is, the up-and-down direction in FIG. 1 is explained as the "up-and-down direction". Further, a direction in which a medium P is fed by the medium feeding apparatus 1 is explained as a "feeding direction", a direction orthogonal to the feeding direction and a thickness direction of a medium P is explained as a "width direction", and the thickness direction of a medium P orthogonal to the feeding direction and the width direction is explained as a "height direction". In an example of FIG. 1, the front side of the medium feeding apparatus corresponds to the upstream side in the feeding direction and the back side of the medium feeding apparatus corresponds to the downstream side in the feeding direction.

The medium feeding apparatus 1 includes a rotating unit 3 (first member) and a fixed unit 4 (second member). The medium feeding apparatus 1 is placed so that the rotating unit 3 is positioned on the upper side in the up-and-down direction and the fixed unit 4 is positioned on the lower side in the up-and-down direction. The rotating unit 3 is rotatably supported by the fixed unit 4 on the back side in the front-and-rear direction. The rotating unit 3 can rotate relative to the fixed unit 4 about a rotating shaft 5, which is along the width direction, as the center of rotation in a predetermined rotation range.

Further, the medium feeding apparatus 1 includes a hopper 2, a feeder 6, a separator 7, a conveyor 8, and a controller 20.

Stacked media P are loaded on the hopper 2, and the hopper 2 can be moved up and down in the up-and-down direction (the thickness direction of the medium P) and includes a loading surface 2*a* that is formed in a substantially rectangular shape. A plurality of media P are stacked and loaded on the loading surface 2*a* of the hopper 2. Further, the hopper 2 is connected to a hopper driving motor 17 through a power transmission mechanism (not shown). When the hopper driving motor 17 is driven, the hopper 2 is moved up and down in the up-and-down direction according to the quantity of media P loaded on the loading surface 2*a*.

The feeder 6, the separator 7, and the conveyor 8 are provided at a predetermined interval on a conveying path along which a medium P1 is conveyed in the feeding direction. The feeder 6, the separator 7, and the conveyor 8 are positioned in this order from the upstream side toward the downstream side in the feeding direction.

The feeder 6 is a so-called upper picking type sheet feeding mechanism, feeds the media P loaded on the hopper 2, and includes a pick roller 61. The pick roller 61 feeds the uppermost medium P1 among the media P loaded on the hopper 2 and is made of, for example, a material having a large friction force such as foamed rubber so as to have a columnar shape. The pick roller 61 is installed so that the central axis of the pick roller 61 is substantially parallel to the width direction of the loading surface 2*a*, that is, is orthogonal to the feeding direction of the medium P while being along the loading surface 2*a*. Further, the central axis of the pick roller 61 is set on the upper surface of the hopper 2 (on the loading surface 2*a*), and the outer peripheral surface of the pick roller 61 is set at a position that has a predetermined interval interposed between the loading surface 2*a* of the hopper 2 and the outer peripheral surface of the pick roller in the height direction. The media P are loaded on the loading surface 2*a* so that the rear ends of the media P (upstream ends of the media in the feeding direction) are positioned on the upstream side of the pick roller 61 in the feeding direction. The hopper 2 approaches the pick roller 61 by being moved upward in the height direction, and is separated from the pick roller 61 by being moved downward.

Further, the pick roller 61 is connected to a roller driving motor 16 as a driving unit through a transmission gear or a belt (not shown), and is driven by a rotational driving force of the roller driving motor 16 so as to rotate about the central axis thereof as the center of rotation. The pick roller 61 is rotationally driven in a pick direction, that is, in a direction in which the outer peripheral surface of the pick roller 61 faces the separator 7 and the conveyor 8 on the loading surface 2*a* (a clockwise direction shown in FIG. 1 by an arrow).

The separator 7 separates the media P, which are fed from the hopper 2 by the feeder 6, one by one and includes a separating roller 71 (first conveying unit) and a braking roller 72 (second conveying unit). The separating roller 71 is made of, for example, a material having a large friction force such as foamed rubber so as to have a columnar shape. The separating roller 71 is provided on the downstream side of the pick roller 61 in the feeding direction so as to be substantially parallel to the pick roller 61. That is, the separating roller 71 is installed so that the central axis of the separating roller 71 is orthogonal to the feeding direction of the medium P while being along the loading surface 2*a*. Further, the central axis of the separating roller 71 is set on the upper surface of the hopper 2, and the outer peripheral surface of the separating roller 71 is set at a position that has a predetermined interval interposed between the loading surface 2*a* of the hopper 2 and the outer peripheral surface of the separating roller 71 in the height direction. The separating roller 71 is connected to the roller driving motor 16 through a transmission gear or a belt (not shown) for the purpose of making the apparatus compact, and is driven by a rotational driving force of the roller driving motor 16 so as to rotate about the central axis thereof as the center of rotation. That is, the pick roller 61 and the separating roller 71 use the roller driving motor 16 as a driving unit in common. However, the invention is not limited thereto and a driving motor may be separately provided as a driving unit that rotationally drives the separating roller 71. Just like the pick roller 61, the separating roller 71 is rotationally driven in a direction in which the outer peripheral surface of the separating roller 71 faces the conveyor 8 on the loading surface 2*a* (a clockwise direction shown in FIG. 1 by an arrow).

The braking roller 72 restricts the feeding of other media P except for a medium P1 that comes into direct contact with the pick roller 61. The braking roller 72 has substantially the same length as the length of the separating roller 71, and is formed in a columnar shape. Just like the separating roller 71, the braking roller 72 is provided so that the central axis of the braking roller 72 horizontally crosses the feeding direction of the medium P, that is, is along the width direction of the medium P. Further, the braking roller 72 is provided so as to be rotatable about the central axis thereof as a rotation axis. The braking roller 72 is provided so as to face the separating roller 71 and come into contact with the separating roller 71 in the height direction on the side of the loading surface 2*a*, and is pressed against (biased to) the separating roller 71 by a biasing unit (not shown). In this embodiment, a state in which the braking roller 72 comes into contact with the separating roller 71 is also expressed as "press contact" meaning a state in which the braking roller 72 is pressed against separating roller 71 at an arbitrary contact pressure. Since the braking roller 72 comes into press contact with the separating roller 71, the braking roller 72 is rotated following the rotation of the separating roller 71 in a direction in which the outer peripheral surface of the braking roller 72 faces the conveyor 8 on the contact surface between the separating roller 71 and the braking roller 72.

Meanwhile, a structure that stops and separates media P fed together with the uppermost medium P1 fed by the feeder 6 by rotationally driving the braking roller 72 in a direction opposite to the rotational driving direction of the separating roller 71 may be used instead of a structure that presses the braking roller 72 against the separating roller 71 by the biasing unit (not shown). Further, the braking roller 72 only has to be capable of functioning to apply a predetermined conveying load to a medium P entering a gap between the separating roller 71 and the braking roller 72 by coming into press contact with the separating roller 71. For example, the braking roller 72 may be substituted with a structure, such as a separating pad or a separating belt, other than a roller.

The conveyor 8 conveys the medium P1, which is fed by the feeder 6 and has passed through the separator 7, to each unit, which is provided on the further downstream side in the feeding direction, of an apparatus on which the medium feeding apparatus 1 is mounted. For example, when the medium feeding apparatus 1 is mounted on an image reader, an optical unit or the like as an image reading unit that reads images recorded on the medium P1 is provided on the downstream side of the conveyor 8 in the feeding direction. Accordingly, the images of the medium P1, which is conveyed in the image reader by the conveyor 8, are read by the optical unit.

Specifically, the conveyor 8 includes a conveying roller 81 (first conveying unit) that can be rotationally driven and a driven roller 82 (second conveying unit) that can be rotated following the conveying roller 81. The conveying roller 81 and the driven roller 82 have substantially the same length and are formed in a columnar shape. The conveying roller 81 and the driven roller 82 are provided so that the central axis of the conveying roller 81 and the driven roller 82 horizontally cross the feeding direction of the medium P1, that is, are along the width direction of the medium P1. Further, each of the conveying roller 81 and the driven roller 82 is provided so as to be rotatable about the central axis thereof as a rotation axis. The driven roller 82 is provided so as to face the conveying roller 81 and come into contact with the conveying roller 81, and is pressed against (biased to) the conveying roller 81 by a biasing unit (not shown). In this embodiment, a state in which the driven roller 82 comes into contact with the conveying roller 81 is also expressed as "press contact" meaning a state in which the driven roller 82 is pressed against the conveying roller 81 at an arbitrary contact pressure.

When the conveying roller 81 conveys the medium P1, the conveying roller 81 is rotationally driven in a direction in which the outer peripheral surface of the conveying roller 81 faces the inside of the apparatus, to which the medium feeding apparatus 1 is applied, from the separator 7 on the contact surface between the driven roller 82 and the conveying roller 81 (a clockwise direction shown in FIG. 1 by an arrow). Since the driven roller 82 comes into press contact with the conveying roller 81, the driven roller 82 is rotated following the rotation of the conveying roller 81 in a direction in which the outer peripheral surface of the driven roller 82 faces the inside of the apparatus from the separator 7 on the contact surface between the conveying roller 81 and the driven roller 82. Further, the conveyor 8 holds the medium P1 between the outer peripheral surface of the conveying roller 81 and the outer peripheral surface of the driven roller 82 by the pressing of the driven roller 82, and conveys the medium P1 by the rotational driving of the conveying roller 81 as explained above. Furthermore, the medium P1 is conveyed to each unit, which is provided in the apparatus to which the medium feeding apparatus 1 is applied, for example, the optical unit by being sequentially delivered between pairs of rollers that are formed of a plurality of conveying rollers (not shown) and a plurality of driven rollers (not shown) provided along the conveying path.

Meanwhile, the conveying roller 81 is also connected to the roller driving motor 16 through a transmission gear or a belt (not shown) for the purpose of making the apparatus compact. That is, the pick roller 61, the separating roller 71, and the conveying roller 81 use the roller driving motor 16 as a driving unit in common. However, the invention is not limited thereto and a driving motor may be separately provided as a driving unit that rotationally drives the conveying roller 81. Here, the rotational speed of the conveying roller 81 is adjusted by the transmission gear or the like, so that the conveying roller 81 is rotationally driven at a rotational speed relatively higher than the rotational speeds of the pick roller 61 and the separating roller 71. That is, the conveyor 8 can convey the medium P1, which is separated by the separator 7, at a speed higher than the speed of the medium P1 that is fed by the feeder 6. However, the conveyor 8 is not limited thereto, and may convey the medium P1 at the same speed as the speed of the medium P1 that is fed by the feeder 6.

The controller 20 controls the respective units of the medium feeding apparatus 1. Various sensors, such as a medium detecting sensor 14 that detects the presence or absence of the medium P1 on the conveying path and a double-feed detecting sensor 15 that detects the double-feed of the medium P1, the roller driving motor 16, and the hopper driving motor 17 are electrically connected to the controller 20. The controller 20 receives information from various sensors, such as the medium detecting sensor 14 and the double-feed detecting sensor 15. The controller 20 feeds the medium P1 in the feeding direction by controlling the roller driving motor 16 or the hopper driving motor 17 to drive each of the rollers of the feeder 6, the separator 7, and the conveyor 8 or the hopper 2.

As shown in FIG. 1, the controller 20 is physically a microcomputer including hardware, such as a central processing unit (CPU) 20*a*, a random access memory (RAM) 20*b*, a read only memory (ROM) 20*c*, a memory unit 20*d*, such as an electrically erasable and programmable read only memory (EEPROM) or a hard disk drive (HDD), an interface 20*e* that communicates with the respective units provided inside and outside the apparatus, an input device 20*f*, such as a switch, a keyboard, and a mouse, and a display device 20*g* such as a display. All or a part of the respective functions of the controller 20 to be explained below are realized by operating the interface 20*e*, the input device 20*f*, the display device 20*g*, and the like under the control of the CPU 20*a* and reading and writing data on the RAM 20*b*, the ROM 20*c*, and the memory unit 20*d* through the reading of a predetermined application program on the hardware, such as the CPU 20*a*, the RAM 20*b*, and the ROM 20*c*.

Meanwhile, the controller 20 may be built in the medium feeding apparatus 1 so as to be integrated with the medium feeding apparatus 1, or may be provided separately from the medium feeding apparatus 1 like, for example, a personal computer (PC) so as to be connected to the medium feeding apparatus 1 from the outside.

As shown in FIG. 1, the pick roller 61 of the feeder 6, the separating roller 71 of the separator 7, and the conveying roller 81 of the conveyor 8 are installed at the lower end of the rotating unit 3. The braking roller 72 of the separator 7 and the driven roller 82 of the conveyor 8 are installed at the upper end of the fixed unit 4. The hopper 2 is installed on the front side of the fixed unit 4. The rotating shaft 5 of the rotating unit 3 is disposed on the back side of the conveyor 8. The rotating unit 3 is rotated about the rotating shaft 5 as the center of rotation toward the fixed unit 4, and is fixed into the fixed unit 4 so that the braking roller 72 of the separator 7 comes into press contact with the separating roller 71 and the driven roller 82 of the conveyor 8 comes into press contact with the conveying roller 81, that is, the conveying path of the medium P1 is formed between the separating roller 71 and the braking roller 72 of the separator 7 and between the conveying roller 81 and the driven roller 82 of the conveyor 8.

The rotating unit 3 is provided with a lock arm 9. The lock arm 9 is supported by a rotating shaft 10 so as to be rotatable relative to the rotating unit 3. The lock arm 9 uses the rotating shaft 10 as the center of rotation, and includes an arm portion 9*a* that extends in a radial direction and a locking claw (or an engaging clow) 9*b* that is bent at the tip of the arm portion 9*a* in a circumferential direction. Meanwhile, the fixed unit 4 is provided with a lock shaft 11. The lock shaft 11 is disposed substantially parallel to the rotating shaft 10 of the lock arm 9. The locking claw 9*b* of the lock arm 9 is adapted to be in a locking state in which the locking claw 9*b* comes into contact with the lock shaft 11 from below by being inserted below the lock shaft 11 by the rotation of the lock arm 9 about the rotating shaft 10. Meanwhile, although not shown in FIG. 1, the lock arm 9 also includes a locking structure extending in the same direction as the locking claw 9*b* at a position closer to the rotating shaft 10 than the locking claw 9*b*. This locking structure is adapted to be capable of coming into contact with the lock shaft 11 from the side opposite to the locking claw 9*b*. That is, the lock arm 9 can simultaneously restrain the lock shaft 11 from above and below by the locking structure and the locking claw 9*b*.

As shown in FIG. 1, a force Fopen is biased to the rotating unit 3 in a direction in which the rotating unit 3 is rotated upward about the rotating shaft 5. Since the locking claw 9*b* of the lock arm 9 is locked to the lock shaft 11, the upward rotation of the rotating unit 3 caused by the force Fopen is restricted. Accordingly, the conveying path is maintained in the separator 7 and the conveyor 8. That is, in this embodiment, the lock arm 9 functions as a locking member and the lock shaft 11 functions as a receiving member that keeps the position of the rotating unit 3 relative to the fixed unit 4 by locking the lock arm 9.

Figure 27:
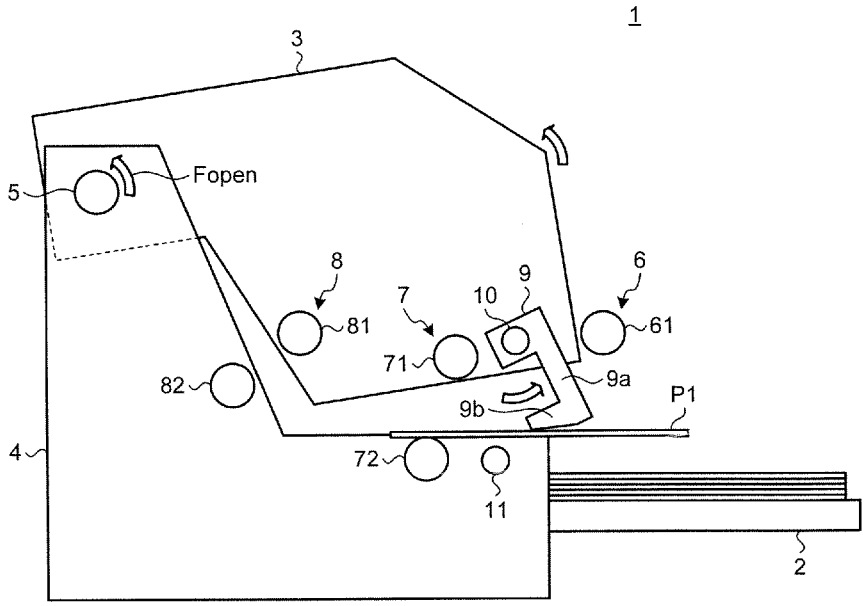
FIG. 27 is a schematic diagram for explaining a state in which a conveying path in the related art is opened.

FIG. 27 is a schematic diagram for explaining a state in which a conveying path in the related art is opened. When a conveying path needs to be opened such as when a conveyance error, such as a jam or double-feed, occurs on the conveying path in the related art, an operator needs to manually rotate a lock arm 9 to release the locking between a locking claw 9*b* and a lock shaft 11 and separate the rotating unit 3 from the fixed unit 4 to the upper side as shown in FIG. 27. Further, after recovery work is completed, the operator needs to manually fit the rotating unit 3 to the fixed unit 4 again and rotate the lock arm 9 to lock the locking claw 9*b* to the lock shaft 11. This work causes total time, which is taken for the recovery work, or the workload of an operator to increase.

Figure 2:
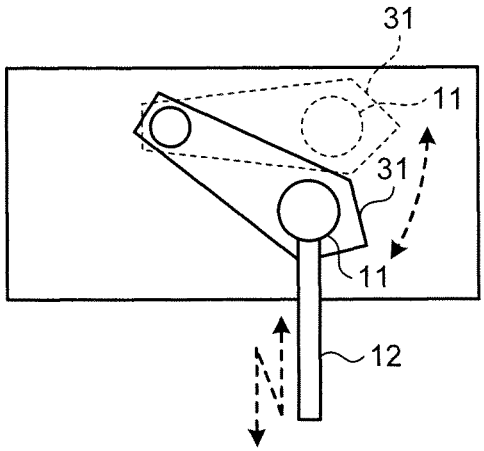
FIG. 2 is a schematic diagram for explaining an example of a structure that moves a lock shaft of FIG. 1 in an up-and-down direction.

In contrast, in this embodiment, the lock shaft 11 is automatically moved in the up-and-down direction while the lock arm 9 is locked to the lock shaft 11. Accordingly, the position of the rotating unit 3 relative to the fixed unit 4 is changed, so that the conveying path is opened and closed. FIG. 2 is a schematic diagram for explaining an example of a structure that moves the lock shaft of FIG. 1 in the up-and-down direction. As shown in FIG. 2, the lock shaft 11 is connected to a movable component 31 that is adapted to be rotatable about a rotation fulcrum, which is substantially parallel to the axial direction of the lock shaft 11, as the center of rotation. Further, a link member 12, which extends downward, is also connected to the lock shaft 11. When the lock shaft 11 receives a thrust from the link member 12 in the up-and-down direction, the lock shaft 11 can be moved in the up-and-down direction while interlocking with the movable component 31 and being rotated about the rotation fulcrum of the movable component 31.

Figure 3:
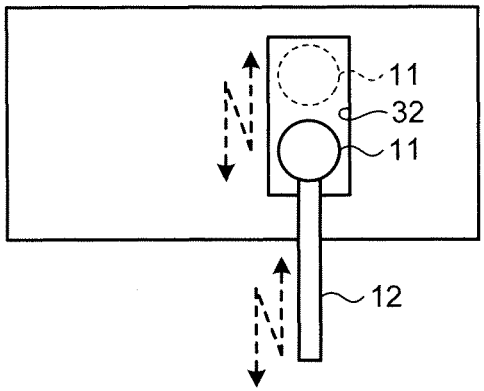
FIG. 3 is a schematic diagram for explaining another example of the structure that moves the lock shaft.

Meanwhile, structures other than the rotating structure shown in FIG. 2 can be appropriately applied as the structure that moves the lock shaft 11 in the up-and-down direction. FIG. 3 is a schematic diagram for explaining another example of the structure that moves the lock shaft. For example, as shown in FIG. 3, a groove 32 along which the lock shaft 11 can slide in the up-and-down direction may be formed in the fixed unit 4 instead of the movable component 31 and the lock shaft 11 may be moved in the groove 32 in the up-and-down direction according to a thrust that is applied to the lock shaft 11 from the link member 12 in the up-and-down direction. Further, the extending direction of the groove 32 is not limited to a linear shape, and the groove 32 may have a curved shape.

As shown in FIG. 1, the link member 12 is a member that linearly extends in the up-and-down direction, an upper end of the link member 12 is connected to the lock shaft 11, and a lower end of the link member 12 is connected to a rotating member 13. The rotating member 13 is supported so as to be rotatable about a rotation fulcrum that is substantially parallel to the axial direction of the lock shaft 11. The rotating member 13 linearly extends in a direction orthogonal to the axial direction of the rotation fulcrum, and one end 13*a* of the rotating member 13 is connected to the link member 12. Further, the other end 13*b* of the rotating member 13 is exposed to the front side of the fixed unit 4, and is disposed so as to be capable of coming into contact with the lower surface of the hopper 2. Furthermore, the rotating member 13 is disposed so that the end 13*b* is positioned above the end 13*a* while the rotating unit 3 is fitted to the fixed unit 4. That is, an angle that is formed between the link member 12 and the rotating member 13 at this time is an acute angle.

In this embodiment, the hopper 2 is adapted to be movable from a "normal position" at which the medium P1 is fed to the conveying path to a "release position" (see FIG. 7), which is present below the normal position, in the up-and-down direction. When the hopper 2 is moved to the release position, the end 13*b* of the rotating member 13 is pressed downward by the lower surface of the hopper 2. Accordingly, the rotating member 13 is rotated in a direction in which the end 13*a* is pushed upward (the clockwise direction in FIG. 1).

Figure 4:
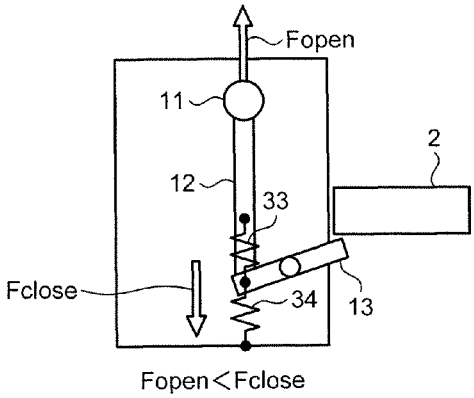
FIG. 4 is a schematic diagram for explaining a structure that positions the lock shaft of the first embodiment.

FIG. 4 is a schematic diagram for explaining a structure that positions the lock shaft of the first embodiment. As shown in FIG. 4, springs 33 and 34 are installed at a connecting portion between the link member 12 and the rotating member 13. When the hopper 2 is at the normal position, the position of the lock shaft 11 in the up-and-down direction is kept constant by the springs 33 and 34. The spring 33 is installed so as to be compressed by the upward movement of the connecting portion and apply a biasing force to the lower side, and the spring 34 is installed so as to be compressed by the downward movement of the connecting portion and apply a biasing force to the upper side. A downward force Fclose is generated by the resultant force of the biasing forces of the springs 33 and 34. The specifications of the springs 33 and 34 are set so that this force Fclose is equal to or larger than an upward force Fopen transmitted to the lock shaft 11 through the locking claw 9*b* of the lock arm 9. Since the downward force Fclose generated by the springs 33 and 34 is applied to the lock shaft 11 through the link member 12, the upward movement of the lock shaft 11 caused by the upward force Fopen is prevented and the position of the lock shaft 11 in the up-and-down direction is determined at a position where the upward force Fopen and the downward force Fclose are balanced with each other. Meanwhile, the force Fclose may be achieved by not the resultant force of the biasing forces of the springs 33 and 34 but only the biasing force of any one of the springs 33 and 34.

Figure 5:
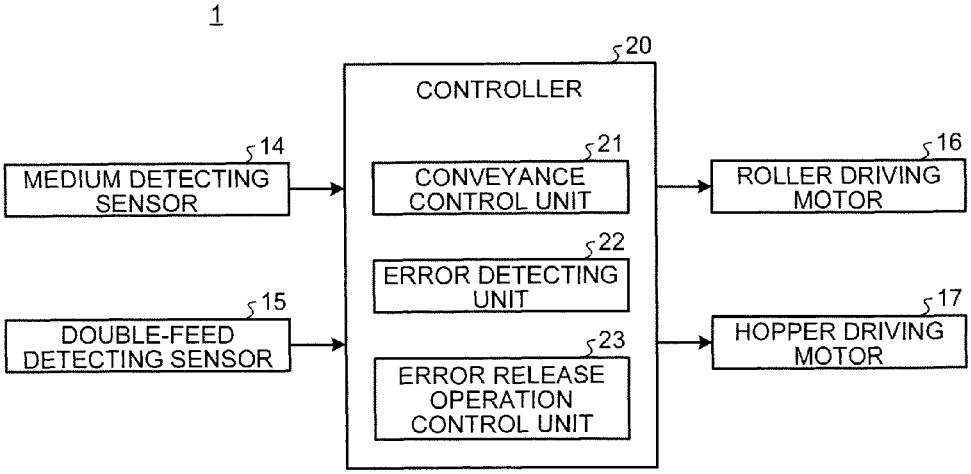
FIG. 5 is a functional block diagram of the medium feeding apparatus shown in FIG. 1.

FIG. 5 is a functional block diagram of the medium feeding apparatus shown in FIG. 1. The controller 20 of this embodiment can perform an operation for automatically opening the conveying path by moving the lock shaft 11 upward as explained above and can perform an operation for automatically closing the conveying path by moving the lock shaft 11 downward after the completion of the recovery work, according to the detection of a conveyance error. In regard to the functions, the controller 20 is adapted to achieve the respective functions of a conveyance control unit 21, an error detecting unit 22, and an error release operation control unit 23 as shown in FIG. 5.

The conveyance control unit 21 controls the conveyance of the medium P1 on the conveying path by controlling the rotation of each of the rollers of the feeder 6, the separator 7, and the conveyor 8 through the adjustment of the controlled variable of the roller driving motor 16. Further, when a conveyance error is detected by the error detecting unit 22, the conveyance control unit 21 stops an operation for conveying the medium P1 by stopping the drive of the roller driving motor 16.

The error detecting unit 22 detects the occurrence of a conveyance error on the conveying path. The error detecting unit 22 can detect a jam (paper jam) on the basis of the delay of the arrival time of the medium P1 or the deflection amount of the medium P1 that is detected by, for example, the medium detecting sensor 14. Further, the error detecting unit 22 can detect double-feed according to a measurement signal of the double-feed detecting sensor 15. When detecting a conveyance error, the error detecting unit 22 outputs an effect that a conveyance error is detected to the conveyance control unit 21 and the error release operation control unit 23.

The error release operation control unit 23 controls an operation for automatically opening/closing the rotating unit 3 according to the occurrence of a conveyance error. When a conveyance error occurs, recovery work for removing a medium P causing the conveyance error from the conveying path needs to be performed by an operator as explained above. The error release operation control unit 23 automatically performs an operation for opening/closing the rotating unit 3 that is performed before and after the recovery work. When a conveyance error is detected by the error detecting unit 22, the error release operation control unit 23 moves the hopper 2 downward by controlling the hopper driving motor 17 and moves the lock shaft 11 upward by applying an upward thrust to the lock shaft 11 through the rotating member 13 and the link member 12. Further, when the recovery work performed by the operator is completed and the removal of the medium P causing the conveyance error from the conveying path is detected, the error release operation control unit 23 moves the hopper 2 upward by controlling the hopper driving motor 17 again and allows the lock shaft 11 to move to the original lower position. In this embodiment, both the recovery work that is associated with the occurrence of a conveyance error and an operation for automatically opening/closing the rotating unit 3 that is performed before and after the recovery work are expressed as an "error release operation".

Figure 6:
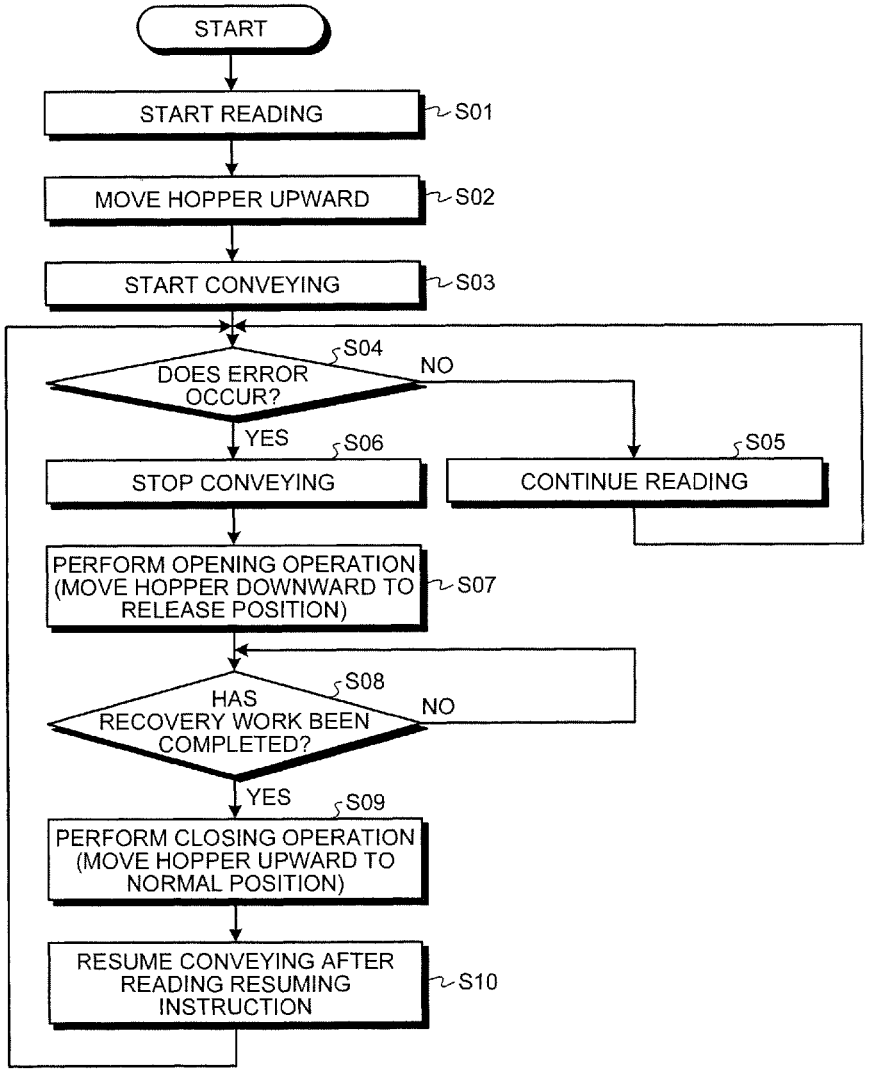
FIG. 6 is a flowchart for explaining error release processing when a conveyance error occurs in the medium feeding apparatus according to this embodiment.
Figure 7:
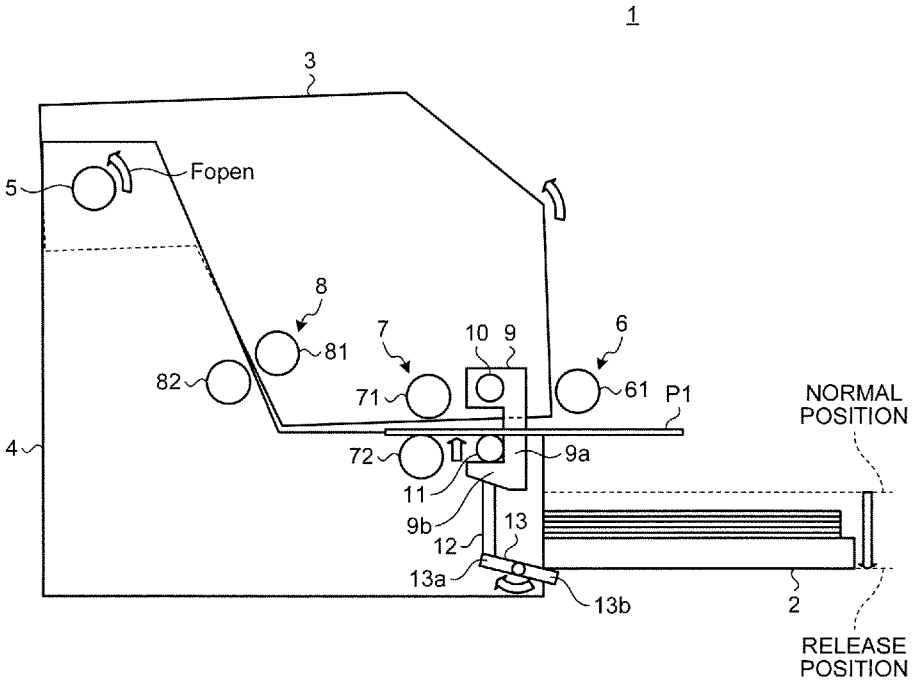
FIG. 7 is a schematic diagram for explaining a state in which a conveying path is opened by an error release operation.

Next, the operation of the medium feeding apparatus 1 according to the first embodiment will be explained with reference to FIGS. 6 and 7. FIG. 6 is a flowchart for explaining error release processing when a conveyance error occurs in the medium feeding apparatus 1 according to this embodiment. FIG. 7 is a schematic diagram for explaining a state in which the conveying path is opened by the error release operation.

In the flowchart of FIG. 6, a structure in which the medium feeding apparatus 1 is applied to an image reader such as a scanner, that is, a situation in which a medium P is conveyed by the medium feeding apparatus 1 when an image reading operation for the medium P is performed by an image reader is exemplified and error release processing will be explained. The processing of the flowchart shown in FIG. 6 is performed by the controller 20 of the medium feeding apparatus 1 whenever an image reading operation for a medium performed by the image reader is performed.

First, when an image reading operation for a medium P is started by an image reader (Step S01), the hopper driving motor 17 is driven by the conveyance control unit 21 so that the position of the hopper 2 in the up-and-down direction is moved upward (Step S02). Further, when the hopper 2 is moved upward until the medium P loaded on the hopper 2 comes into contact with the pick roller 61, the roller driving motor 16 is subsequently driven, each of the rollers of the feeder 6, the separator 7, and the conveyor 8 is rotated, and an operation for conveying the medium P loaded on the hopper 2 to the image reader provided on the downstream side in the conveying direction is started (Step S03).

During the operation for conveying the medium performed by the conveyance control unit 21, the error detecting unit 22 sequentially checks whether a conveyance error, such as double-feed or a jam, occurs on the conveying path (Step S04). If a conveyance error does not occur as a result of the determination of Step S04 (No in Step S04), the conveying operation performed by the conveyance control unit 21 and the image reading operation performed by the image reader are continued (Step S05) and a process returns to the determination of Step S04.

Meanwhile, if it is determined that a conveyance error occurs as a result of the determination of Step S04 (Yes in Step S04), the conveying operation is stopped by the conveyance control unit 21 to make an operator perform recovery work from a state in which the conveyance error occurs (Step S06) and an "opening operation" is performed by the error release operation control unit 23 (Step S07).

The "opening operation" performed in Step S07 is an operation for moving the position of the hopper 2 downward in the up-and-down direction from the "normal position" at which a conveying operation for feeding the medium P to the conveying path is performed to the "release position", which is present below the normal position, as shown in FIG. 7. The error release operation control unit 23 moves the hopper 2 downward by driving the hopper driving motor 17. When the hopper 2 is moved downward to the release position by the opening operation, the end 13*b* of the rotating member 13 comes into contact with the lower surface of the hopper 2 and is pressed downward. Accordingly, the rotating member 13 is rotated about the rotation fulcrum as the center of rotation in the direction in which the end 13*b* is moved downward (the clockwise direction shown in FIG. 7 by an arrow). Since the end 13*a* of the rotating member 13 is moved upward by the rotation of the rotating member 13, the link member 12 connected to the end 13*a* is moved upward and the position of the lock shaft 11 connected to the link member 12 in the up-and-down direction is also moved upward.

At this time, the locking claw 9*b* of the lock arm 9 comes into contact with the lock shaft 11 from below and receives the force Fopen in the direction in which the rotating unit 3 is rotated upward about the rotating shaft 5 through the rotating shaft 10 and the arm portion 9*a*. For this reason, the lock arm 9 is moved upward with the upward movement of the lock shaft 11 in the up-and-down direction while following the lock shaft 11. Accordingly, the rotating unit 3 is rotated upward by a distance at which the lock shaft 11 and the lock arm 9 are moved upward. As a result, a gap is formed between the rollers of each of the separator 7 and the conveyor 8 and the conveying path is opened.

The operator of the image reader performs recovery work for removing a medium P, which corresponds to a conveyance error, from the conveying path while the conveying path is opened by the opening operation of Step S07. During the recovery work, the error release operation control unit 23 checks whether the recovery work has been completed (Step S08).

The completion of the recovery work can be determined on the basis of, for example, a detection signal of the medium detecting sensor 14 that is provided on the conveying path. Here, the medium detecting sensor 14 is a sensor that detects the presence or absence of a medium P on the conveying path. For example, when a medium P is present in the detection range of the medium detecting sensor 14, the detection signal of the medium detecting sensor 14 is in an ON state. Meanwhile, when a medium P is not present in the detection range of the medium detecting sensor 14, the detection signal of the medium detecting sensor 14 is in an OFF state. The medium detecting sensors 14 are installed, for example, between the feeder 6, the separator 7, and the conveyor 8, respectively, that is, a plurality of medium detecting sensors 14 are installed on the conveying path. The controller 20 can specify the position of a medium P on the conveying path with reference to the detection signals of these medium detecting sensors 14. Since the medium P stays on the conveying path when a conveyance error occurs, at least one of the medium detecting sensors 14 is in an ON state. Meanwhile, when the recovery work has been completed and the medium P has been removed from the conveying path, all of the detection signals of the medium detecting sensors 14 are in an OFF state. That is, it can be determined that the recovery work has been completed when the detection signals of the medium detecting sensors 14 are in an OFF state.

Meanwhile, a method other than a method using the medium detecting sensors 14 may be used as a method of determining the completion of the recovery work. For example, a method of determining the completion of the recovery work using the information of various sensors other than the medium detecting sensors 14 installed in the medium feeding apparatus 1 may be used, and a method of detecting the completion of the recovery work by the input of an instruction of an operator may be used.

If the recovery work is not completed as a result of the determination of Step S08 (No in Step S08), a process waits until the completion of the recovery work is determined. Meanwhile, if the recovery work is completed (Yes in Step S08), a "closing operation" is performed by the error release operation control unit 23 (Step S09).

The "closing operation" performed in Step S09 is an operation reverse to the opening operation of Step S07. That is, the closing operation is an operation for returning the position of the hopper 2 in the up-and-down direction to the "normal position" by moving the position of the hopper 2 upward from the "release position" to which the hopper 2 has been moved by the opening operation. The error release operation control unit 23 moves the hopper 2 upward by driving the hopper driving motor 17. When the hopper 2 is moved upward from the release position by the closing operation, a downward pressing force applied to the end 13*b* of the rotating member 13 from the lower surface of the hopper 2 is removed. For this reason, the rotating member 13 is rotated by a downward biasing force Fclose, which is generated by the springs 33 and 34 (see FIG. 4) connected to the end 13*a*, in the direction in which the end 13*a* is moved downward (the counterclockwise direction in FIG. 7). The link member 12 connected to the end 13*a* of the rotating member 13 is moved downward by the rotation of the rotating member 13, and the position of the lock shaft 11, which is connected to the link member 12, in the up-and-down direction is also moved downward.

At this time, the locking claw 9*b* of the lock arm 9 comes into contact with the lock shaft 11 from below and receives the force Fopen in the direction in which the rotating unit 3 is rotated upward about the rotating shaft 5 through the rotating shaft 10 and the arm portion 9*a*. Further, the locking claw 9*b* receives a downward pressing force Fclose from the lock shaft 11 since the position of the lock shaft 11 in the up-and-down direction is moved downward. As explained with reference to FIG. 4, the downward biasing force Fclose generated by the springs 33 and 34 is set to be larger than the upward force Fopen (Fopen<Fclose). For this reason, the positions of the lock arm 9 and the lock shaft 11 in the up-and-down direction are moved downward against the force Fopen. Accordingly, the rotating unit 3 is rotated downward by a downward moving distance of the lock shaft 11 and the lock arm 9. As a result, the rollers of each of the separator 7 and the conveyor 8 come into press contact with each other and the conveying path is closed, so that a state returns to a state in which a medium can be conveyed to the conveying path. That is, a state can be changed into the state shown in FIG. 1 from the state shown in FIG. 7 by the closing operation.

When the closing operation is completed and the conveying path is closed again, a conveying operation is resumed by the conveyance control unit 21 after the reception of a reading resuming instruction input by an operator (S10). The process returns to Step S04 after resumption of the conveying operation, and whether a conveyance error occurs is monitored again by the error detecting unit 22.

As explained with reference to FIGS. 6 and 7, in this embodiment, a downward thrust applied by the hopper 2 is converted into an upward thrust by the rotating member 13 and the link member 12 and is transmitted to the lock shaft 11 according to the downward movement of the hopper 2 to the release position from the normal position. Accordingly, the lock shaft 11 is moved upward. Further, the rotating unit 3 is rotated upward to be separated from the fixed unit 4 by the upward movement of the lock shaft 11, so that the conveying path is opened. Meanwhile, since a downward thrust applied to the rotating member 13 by the hopper 2 is removed according to the upward movement of the hopper 2 to the normal position from the release position, the lock shaft 11 is moved downward to return to the original position. Furthermore, the rotating unit 3 is rotated downward by the downward movement of the lock shaft 11 so as to approach the fixed unit 4, so that the conveying path is closed. That is, in this embodiment, the link member 12 and the rotating member 13 function as a position changing unit that moves the lock shaft 11 in a direction in which the lock shaft 11 approaches the rotating unit 3 by using a force that is applied by the downward movement of the hopper 2 at the time of the occurrence of a conveyance error and returns the lock shaft 11 to the original position by the movement of the hopper 2 to the original position after the completion of the recovery work.

Next, the effects of the medium feeding apparatus 1 according to the first embodiment will be explained.

The medium feeding apparatus 1 according to the first embodiment includes: the rotating unit 3; the fixed unit 4; the separating roller 71 and the conveying roller 81 that are installed in the rotating unit 3 and convey a medium present on the conveying path in the conveying direction; the braking roller 72 and the driven roller 82 that are installed in the fixed unit 4 and come into press contact with the separating roller 71 and the conveying roller 81 on the conveying path, respectively; the lock arm 9 that is installed in the rotating unit 3; the lock shaft 11 that is installed in the fixed unit 4 and keeps the position of the rotating unit 3 relative to the fixed unit 4 by locking the lock arm 9; and the position changing unit (the link member 12 and the rotating member 13) that changes the position of the rotating unit 3 relative to the fixed unit 4 by the movement of the lock shaft 11 in the up-and-down direction.

Further, in the medium feeding apparatus 1, the lock arm 9 is adapted to be rotatable in a predetermined direction and is locked to the lock shaft 11 by being rotated. The lock shaft 11 comes into contact with the locking claw 9*b* of the lock arm 9 and prevents the rotating unit 3 from being separated from the fixed unit 4 by restricting the movement of the lock arm 9 toward the rotating unit 3.

According to this structure, the position of the rotating unit 3 relative to the fixed unit 4 is changed by the movement of the lock shaft 11 in the up-and-down direction, so that an operation for opening/closing the rotating unit 3 with respect to the fixed unit 4 can be performed. Accordingly, even though an operator does not operate the lock arm 9, the operator can open and close the rotating unit 3. For this reason, when a conveyance error occurs, the medium feeding apparatus can immediately open the rotating unit 3 and open the conveying path by automatically moving the lock shaft 11 without waiting for the opening operation of an operator. Therefore, an operator can quickly perform recovery work. Further, when the recovery work is completed and the lock shaft 11 is driven again, the rotating unit 3 is automatically closed. Since an operation for opening/closing the conveying path associated with the recovery work can be automatically performed in this way, the time, which is taken for the operation for opening/closing the rotating unit 3 performed before and after the recovery work, can be reduced and the workload of an operator caused by the operation for opening/closing the rotating unit 3 can be reduced. As a result, the efficiency of the recovery work can be improved.

Furthermore, the medium feeding apparatus 1 according to the first embodiment includes the hopper 2 on which media P are loaded, and the hopper 2 is adapted to be moved downward at the time of occurrence of a conveyance error of a medium P and return to the original position after the completion of the recovery work for the conveyance error. The position changing unit moves the lock shaft 11 in a direction in which the lock shaft 11 approaches the rotating unit 3 by using a force that is applied by the downward movement of the hopper 2 at the time of the occurrence of a conveyance error, and returns the lock shaft 11 to the original position by the movement of the hopper 2 to the original position after the completion of the recovery work.

According to this structure, since the hopper 2, which is an existing component of the medium feeding apparatus 1, can be used as a driving source that is used to move the lock shaft 11 in the up-and-down direction, a new driving source used to drive the lock shaft 11 does not need to be installed. As a result, space can be saved and cost can be reduced.

Modification of First Embodiment

Figure 8:
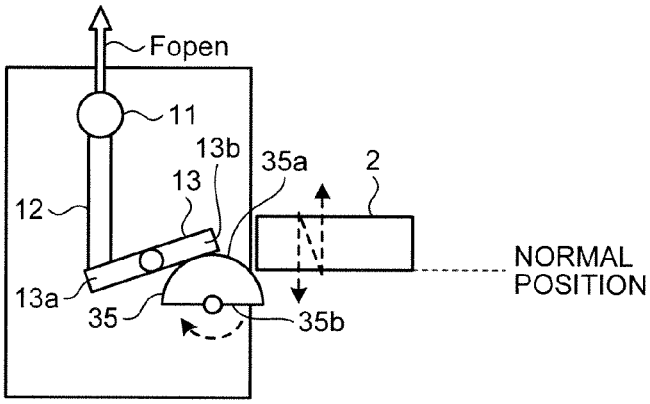
FIG. 8 is a schematic diagram for explaining a structure that positions a lock shaft when a hopper is at a normal position in a modification of the first embodiment.
Figure 9:
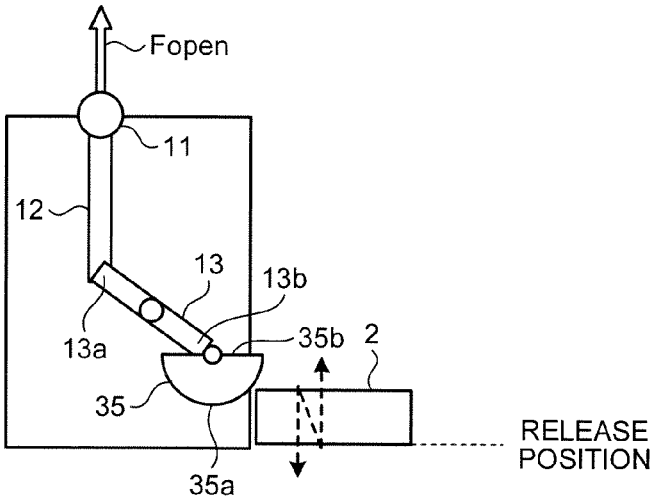
FIG. 9 is a schematic diagram for explaining the structure that positions the lock shaft when the hopper is at a release position in the modification of the first embodiment.

A modification of the first embodiment will be explained with reference to FIGS. 8 and 9. FIG. 8 is a schematic diagram for explaining a structure that positions a lock shaft when a hopper is at a normal position in a modification of the first embodiment. FIG. 9 is a schematic diagram for explaining the structure that positions the lock shaft when the hopper is at a release position in the modification of the first embodiment.

In the first embodiment, the structure including the link member 12 that is connected to the lock shaft 11, the rotating member 13 that is disposed so that one end 13*a* is connected to the link member 12 and the other end 13*b* can come into contact with the lower surface of the hopper 2, and the springs 33 and 34 that are connected to the connecting portion between the link member 12 and the rotating member 13 as shown in FIG. 4 has been exemplified as a structure that positions the lock shaft 11 according to the movement of the hopper 2 in the up-and-down direction. However, other structure may be used as the structure that positions the lock shaft by transmitting power between the hopper 2 and the lock shaft 11. For example, as shown in FIGS. 8 and 9, the end 13*b* of the rotating member 13 does not come into direct contact with the hopper 2 and a cam member 35 may be disposed between the rotating member 13 and the hopper 2.

The cam member 35 is a member having the shape of a semi-disc, and includes a circumferential surface 35*a* along the semicircular arc and a diameter surface 35*b* along the diameter in the thickness direction of the semi-disc. The circumferential surface 35*a* and the diameter surface 35*b* form the entire peripheral surface of the cam member 35. The cam member 35 is installed so as to be rotatable about the middle point in the linear direction along the diameter surface 35*b*, that is, the center point of the arc shape of the circumferential surface 35*a* as a rotation fulcrum. The axial direction of the rotation fulcrum of the cam member 35 is the thickness direction of the semi-disc, and the cam member 35 is installed so that this axial direction is substantially parallel to the axial direction of the rotating member 13. The position of the rotation fulcrum of the cam member 35 is disposed below the rotation fulcrum of the rotating member 13 in the up-and-down direction and in front of the rotation fulcrum of the rotating member 13 in the front-and-rear direction. Further, the position of the rotation fulcrum of the cam member 35 in the up-and-down direction is disposed between the normal position and the release position of the hopper 2.

When the hopper 2 is at the normal position, the circumferential surface 35*a* of the cam member 35 comes into contact with the end 13*b* of the rotating member 13. At this time, as shown in FIG. 8, the circumferential surface 35*a* is positioned above the rotation fulcrum of the cam member 35 and the end 13*b* of the rotating member 13 coming into contact with the circumferential surface 35*a* is positioned above the opposite end 13*a*. A force Fopen in a direction in which the rotating unit 3 is rotated upward is transmitted to the lock shaft 11 through the lock arm 9, but the cam member 35 receives the force Fopen by the circumferential surface 35*a* through the link member 12 and the rotating member 13.

Meanwhile, when the hopper 2 is moved down to the release position below the normal position, the circumferential surface 35*a* of the cam member 35 receives a downward thrust from the lower surface of the hopper 2 and the cam member 35 is rotated in a direction in which the contact point between the hopper 2 and the cam member 35 is moved downward (a clockwise direction in FIGS. 8 and 9). Accordingly, when the hopper 2 is moved down to the release position as shown in FIG. 9, the cam member 35 is rotated by a half turn so that the circumferential surface 35*a* is positioned below the rotation fulcrum. Since the position of the contact point between the end 13*b* of the rotating member 13 and the cam member 35 in the up-and-down direction is moved downward as compared to when the hopper 2 is at the normal position, the opposite end 13*a* is moved upward as much as that. As a result, the link member 12 connected to the end 13*a* of the rotating member 13 and the lock shaft 11 connected to the link member 12 are also moved upward in the up-and-down direction. Even in this state, the diameter surface 35*b* of the cam member 35 receives the force Fopen in the direction in which the rotating unit 3 is rotated upward through the link member 12 and the rotating member 13.

In this way, the cam member 35 has a function as a stopper that can suppress the force Fopen opening the rotating unit 3 upward by a rigid body. Meanwhile, as long as the function of the stopper is achieved, the cam member 35 may be substituted with, for example, a member, such as a member sliding in the up-and-down direction while interlocking with the hopper 2, other than members that have the same rotating structure as the cam member 35.

Second Embodiment

Figure 10:
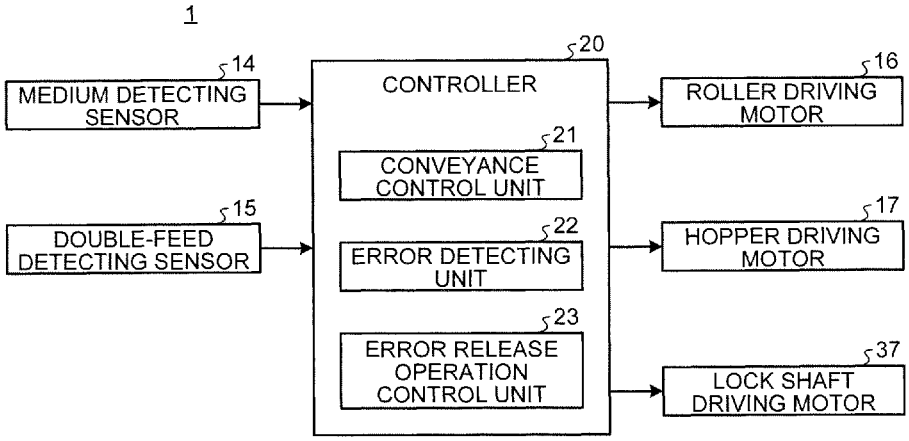
FIG. 10 is a functional block diagram of a medium feeding apparatus according to a second embodiment.

A second embodiment of the invention will be explained with reference to FIGS. 10 to 16. FIG. 10 is a functional block diagram of a medium feeding apparatus according to a second embodiment, and FIGS. 11 to 16 are schematic diagrams for explaining examples of a structure that positions a lock shaft of the second embodiment.

In the first embodiment, the structure that positions the lock shaft 11 in the up-and-down direction has interlocked with the movement of the hopper 2. However, in the second embodiment, the structure that positions the lock shaft 11 in the up-and-down direction is formed of a structure that includes an independent driving source and an interlock unit moving the lock shaft 11 in the up-and-down direction by the drive of the driving source. The second embodiment is different from the first embodiment in terms of this structure.

As shown in FIG. 10, in this embodiment, a medium feeding apparatus 1 includes a lock shaft driving motor 37 that is an independent driving source used to move the lock shaft 11. The lock shaft driving motor 37 is driven and controlled by the error release operation control unit 23 of the controller 20 when moving the lock shaft 11 in the up-and-down direction.

For example, various interlock units can be applied between the lock shaft driving motor 37 and the lock shaft 11 as shown in FIGS. 11 to 16. Here, the structure that has been explained with reference to FIG. 2 and moves the lock shaft 11 in the up-and-down direction while the lock shaft 11 interlocks with the movable component 31 and is rotated about the rotation fulcrum of the movable component 31 will be exemplified and explained as a structure that moves the lock shaft 11 in the up-and-down direction.

Figure 11:
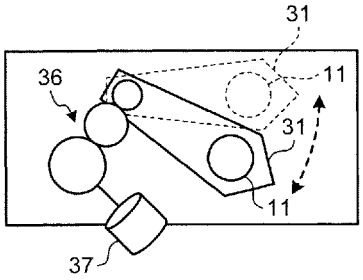
FIG. 11 is a schematic diagram for explaining an example of a structure that positions a lock shaft of the second embodiment.

For example, as shown in FIG. 11, gear transmission can be applied as an interlock unit applied between the lock shaft driving motor 37 and the lock shaft 11. In this method, a gear train 36 is installed between the lock shaft driving motor 37 and the rotation fulcrum of the movable component 31. The rotation of the lock shaft driving motor 37 is decelerated by the gear train 36 and is transmitted to the rotation fulcrum of the movable component (or member) 31. Accordingly, the movable component 31 is rotated about the rotation fulcrum and can move the lock shaft 11 in the up-and-down direction.

Figure 12:
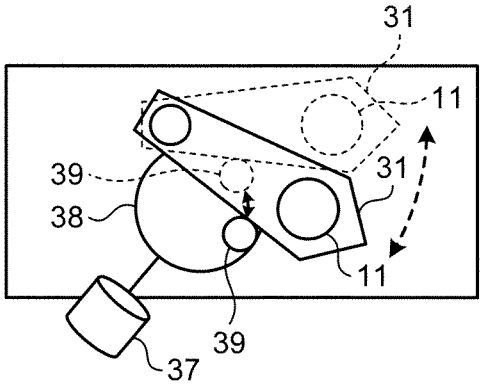
FIG. 12 is a schematic diagram for explaining the example of the structure that positions the lock shaft of the second embodiment.

As shown in FIG. 12, a cam mechanism can be applied as the interlock unit applied between the lock shaft driving motor 37 and the lock shaft 11. A cam 38, which is rotated while interlocking with the lock shaft driving motor 37, is provided in this method. The cam 38 is installed so that the rotation axis of the cam 38 is substantially parallel to the rotation fulcrum of the movable component 31. A protrusion 39 is provided on the disc surface of the cam 38. The extending direction of the protrusion 39 is also substantially the same as the direction of the rotation axis of the cam 38. The cam 38 is disposed so that at least a part of the cam 38 overlaps the movable component 31 when seen in the axial direction. In addition, the cam 38 is disposed so that the protrusion 39 comes into contact with the movable component 31 from the lower side of the movable component 31. According to this structure, when the cam 38 is rotated by the drive of the lock shaft driving motor 37, a thrust is transmitted to the movable component 31 through the protrusion 39 to rotate the movable component 31. Accordingly, the lock shaft 11 can be moved in the up-and-down direction.

Figure 13:
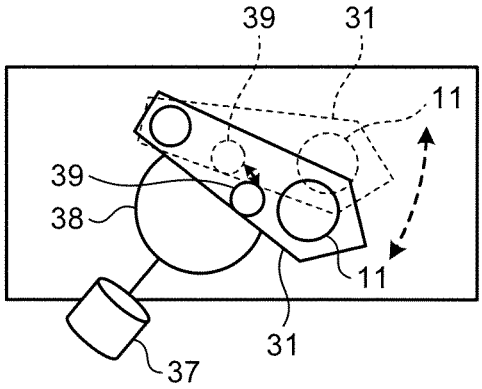
FIG. 13 is a schematic diagram for explaining the example of the structure that positions the lock shaft of the second embodiment.

Meanwhile, when the cam mechanism is applied, the protrusion 39 of the cam 38 may be rotatably fitted to the movable component 31 as shown in FIG. 13. Accordingly, for example, even when an external force is applied to the lock shaft 11 so that a force is applied to the movable component 31 in a direction in which the movable component 31 and the protrusion 39 are separated from each other, the protrusion 39, the cam 38, and the like can receive the force. Accordingly, the operation of the movable component 31 can be restricted by only the interlocking rotation with the protrusion 39.

Figure 14:
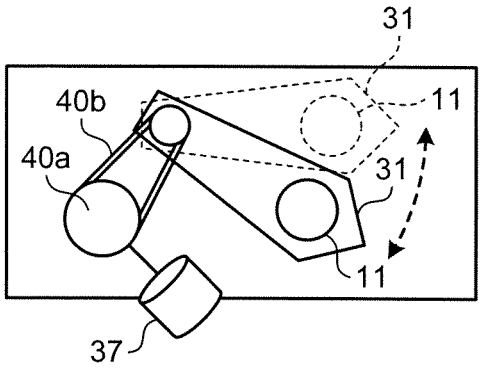
FIG. 14 is a schematic diagram for explaining the example of the structure that positions the lock shaft of the second embodiment.

As shown in FIG. 14, a belt mechanism can be applied as the interlock unit applied between the lock shaft driving motor 37 and the lock shaft 11. In this method, a pulley 40*a* and a belt 40*b* are installed between the lock shaft driving motor 37 and the rotation fulcrum of the movable component 31. The belt 40*b* connects the pulley 40*a* with the rotation fulcrum of the movable component 31. When the lock shaft driving motor 37 is driven and the pulley 40*a* is rotated, a driving force is transmitted to the rotation fulcrum of the movable component (or member) 31 through the belt 40*b*. Accordingly, the movable component 31 is rotated about the rotation fulcrum and can move the lock shaft 11 in the up-and-down direction.

Figure 15:
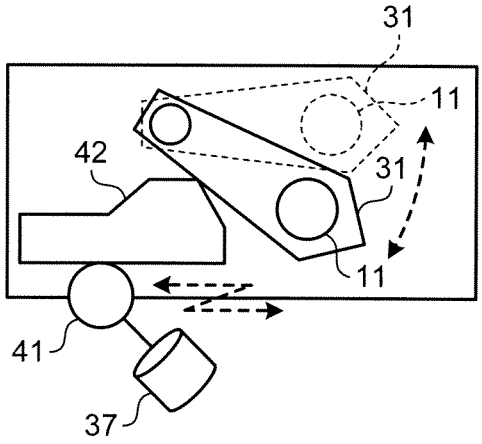
FIG. 15 is a schematic diagram for explaining the example of the structure that positions the lock shaft of the second embodiment.

As shown in FIG. 15, a slider mechanism can be applied as the interlock unit applied between the lock shaft driving motor 37 and the lock shaft 11. A gear 41 that is rotated while interlocking with the lock shaft driving motor 37 and a slider 42 that slides according to the rotation of the gear 41 are provided in this method. The slider 42 is disposed so as to come into contact with the movable component 31 from the lower side of the movable component 31, and is disposed so that the movable component 31 is rotated by the sliding of the slider 42. When the lock shaft driving motor 37 is driven and the gear 41 is rotated, the slider 42 slides, transmits a thrust to the movable component 31 through the contact portion between the slider 42 and the movable component 31, rotates the movable component 31, and can move the lock shaft 11 in the up-and-down direction.

Figure 16:
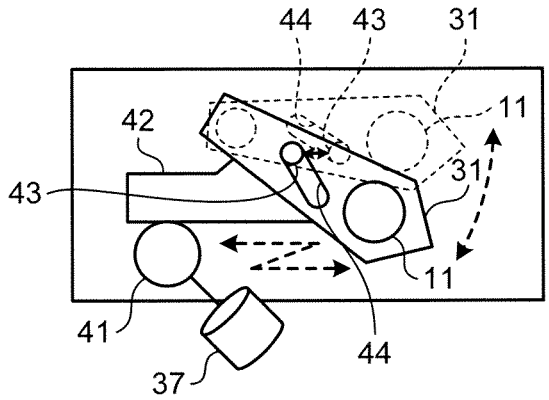
FIG. 16 is a schematic diagram for explaining the example of the structure that positions the lock shaft of the second embodiment.

Meanwhile, when the slider mechanism is applied, the operation of the movable component 31 may be restricted by only the interlocking rotation with the slider 42 as shown in FIG. 16. The slider 42 is disposed so that at least a part of the slider 42 overlaps the movable component 31 when seen in the axial direction of the movable component 31. A protrusion 43 is provided on the surface of the slider 42 facing the movable component 31. Further, the movable component 31 is provided with a groove 44 to which the protrusion 43 is fitted and which allows the protrusion 43 to slide in a predetermined direction. The groove 44 of the movable component 31 is formed so as to be capable of converting a thrust, which is transmitted through the protrusion 43 according to the sliding of the slider 42, into the rotation of the movable component 31. Accordingly, for example, even when an external force is applied to the lock shaft 11 so that a force is applied to the movable component 31 in a direction in which the movable component 31 and the slider 42 are separated from each other, the slider 42, the gear 41, or the like can receive the force through the protrusion 43 fitted to the groove 44 of the movable component 31. Accordingly, the operation of the movable component 31 can be restricted by only the interlocking rotation with the protrusion 43.

As explained above, in the medium feeding apparatus 1 according to the second embodiment, the lock shaft driving motor 37 and the interlock units exemplified in FIGS. 11 to 16 that move the lock shaft 11 by the drive of the lock shaft driving motor 37 in a direction in which the lock shaft 11 approaches or is separated from the rotating unit 3 are provided as the unit that changes the position of the lock shaft 11 in the up-and-down direction.

According to this structure, since the lock shaft 11 can be independently moved in the up-and-down direction and there is no restriction such as interlocking between the operations of the medium feeding apparatus 1 and other components, the degree of freedom of the operation for opening/closing the rotating unit 3 and the conveying path can be improved.

Meanwhile, the driving source only has to be capable of transmitting power through the interlock unit, and the medium feeding apparatus only has to include a driving source that moves the lock shaft 11 and may use a driving source such as other motors provided in the medium feeding apparatus without including a dedicated lock shaft driving motor 37 that moves the lock shaft 11. For example, since the drive of the rollers is stopped when an error occurs, a roller driving motor may be used.

Third Embodiment

Figure 17:
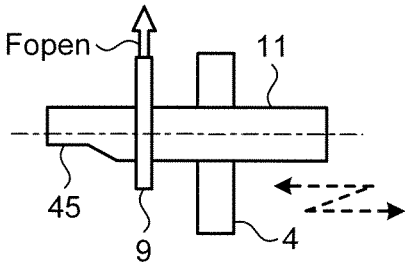
FIG. 17 is a schematic diagram for explaining the structure of a lock shaft of a third embodiment.
Figure 19:
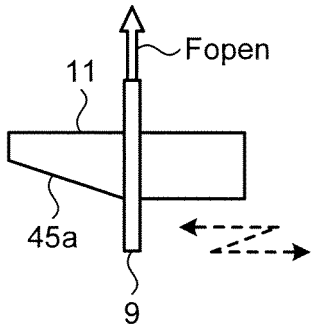
FIG. 19 is a schematic diagram for explaining another example of the shape of the lock shaft.
Figure 20:
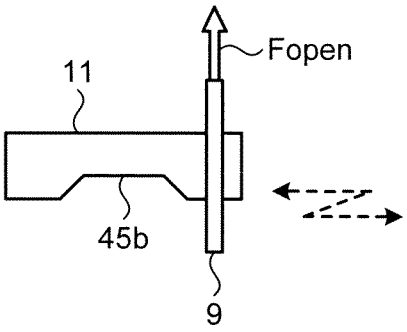
FIG. 20 is a schematic diagram for explaining still another example of the shape of the lock shaft.
Figure 21:
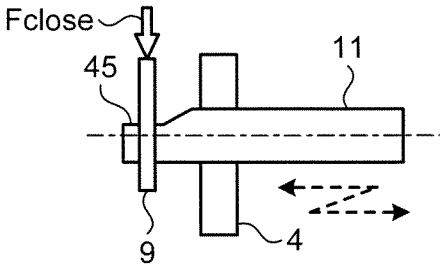
FIG. 21 is a schematic diagram for explaining the structure of the lock shaft of the third embodiment when a downward force is applied to the lock arm.

A third embodiment of the invention will be explained with reference to FIGS. 17 to 21. FIG. 17 is a schematic diagram for explaining the structure of a lock shaft of a third embodiment, FIG. 18 is a schematic diagram for explaining the operations of the lock shaft and a lock arm when an opening operation is performed, FIGS. 19 and 20 are schematic diagrams for explaining other examples of the shape of the lock shaft, and FIG. 21 is a schematic diagram for explaining the structure of the lock shaft of the third embodiment when a downward force is applied to the lock arm.

In the first and second embodiments, the operation for automatically opening/colosing the conveying path has been performed by the movement of the lock shaft 11 in the up-and-down direction. However, the third embodiment is different from the first and second embodiments in that the moving direction of the lock shaft 11 is an axial direction. Meanwhile, the method used in the first or second embodiment can be used as a method of moving the lock shaft 11 in the axial direction.

Figure 18:
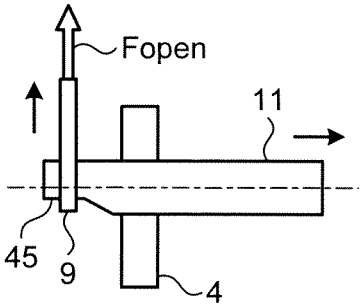
FIG. 18 is a schematic diagram for explaining the operations of the lock shaft and a lock arm when an opening operation is performed.

As shown in FIGS. 17 and 18, a cutout portion 45 is formed at one end of the lock shaft 11. The cutout portion 45 and the peripheral surface of the lock shaft 11 are connected to each other with an inclined surface interposed therebetween. That is, the lock shaft 11 has a plurality of cross-sectional shapes in the axial direction.

Further, in this embodiment, the lock shaft 11 is installed so that the cutout portion 45 faces vertically downward. That is, the cutout portion 45 is disposed above the lowermost portion of the peripheral surface of the lock shaft 11 in the up-and-down direction.

In a normal state in which the rotating unit 3 is fitted to the fixed unit 4 and the conveying path is closed, the lock arm 9 comes into contact with the peripheral surface of the lock shaft 11 as shown in FIG. 17. In more detail, the engaging claw (or locking clow) 9*b* of the lock arm 9 bumps against the peripheral surface of the lock shaft 11 from below as explained above.

When an opening operation is performed, the lock shaft 11 slides in the axial direction (to the right side in FIG. 18) as shown in FIG. 18. Accordingly, the lock arm 9 is switched into a state in which the lock arm 9 comes into contact with the cutout portion 45 from a state in which the lock arm 9 comes into contact with the peripheral surface of the lock shaft 11, via the inclined surface. Therefore, since a height position where the lock arm 9 and the lock shaft 11 come into contact with each other is moved upward, the lock arm 9 is moved upward by the upward force Fopen. As a result, the rotating unit 3 connected to the lock arm 9 is also rotated upward and the conveying path is opened.

When a closing operation is performed, the lock shaft 11 moves in a direction opposite to the direction corresponding to the opening operation (to the left side in FIG. 18). Accordingly, since the contact position between the lock arm 9 and the lock shaft 11 is changed to the peripheral surface from the cutout portion 45, the lock arm 9 is moved downward and the rotating unit 3 is also moved downward. Finally, a state returns to the normal state shown in FIG. 17 and the conveying path is closed.

Meanwhile, as long as the contact position between the lock arm 9 and the lock shaft 11 can be moved upward according to the horizontal movement of the lock shaft 11, the shape of the cutout portion 45 formed at the lock shaft 11 may be different from the shape shown in FIGS. 17 and 18. For example, a tapered cutout portion 45*a*, which connects the peripheral surface with the facet, may be formed as shown in FIG. 19. The contact position between the lock arm 9 and the lock shaft 11 only has to be capable of changing between the peripheral surface and the cutout portion before and after an operation for opening/closing the conveying path. For example, a cutout portion 45*b* may be formed at not an end of the lock shaft 11 but a middle portion of the lock shaft as shown in FIG. 20.

Further, the structure in which the force Fopen rotating the rotating unit 3 upward is normally applied to the rotating unit 3 has been exemplified in this embodiment. However, it is also considered that, conversely, a force in a direction in which the rotating unit 3 approaches the fixed unit 4, that is, a force Fclose rotating the rotating unit 3 downward is applied. At this time, a force transmitted to the lock arm 9 is a downward force. In this case, if the lock shaft 11 of this embodiment is installed so that the cutout portion 45 faces vertically upward as shown in FIG. 21, the same operation as explained above can be performed.

Fourth Embodiment

Figure 22:
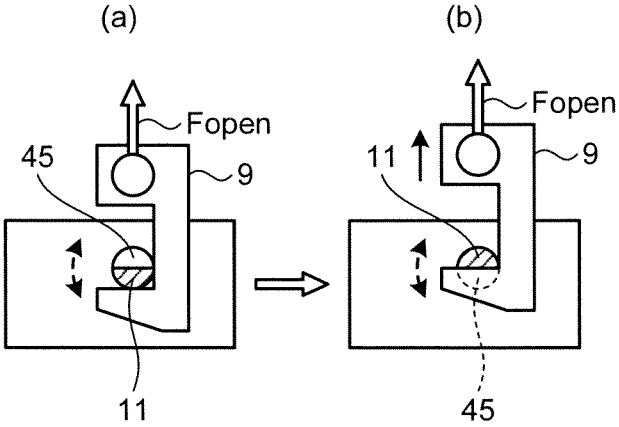
FIG. 22 is a schematic diagram for explaining the structure and the operation of a lock shaft of a fourth embodiment.

A fourth embodiment will be explained with reference to FIG. 22. FIG. 22 is a schematic diagram for explaining the structure and the operation of a lock shaft of the fourth embodiment.

The fourth embodiment is different from the third embodiment in that the moving direction of the lock shaft 11 corresponds to rotation about an axis.

The lock shaft 11 is installed so that a cutout portion 45 faces vertically upward in a normal state as shown in FIG. 22(*a*). The lock shaft 11 is adapted to be substantially rotated about an axis by a half turn as shown in FIG. 22(*b*) when an opening operation is performed. The lock shaft 11 is installed so as to come into contact with the engaging claw 9*b* of the lock arm 9 in a range where the cutout portion 45 is present in the axial direction. Meanwhile, in this embodiment, the shape of the cutout portion 45 may be formed by, for example, D-cutting or the like so as not to include an inclined surface between the cutout portion and the peripheral surface unlike in the third embodiment.

As shown in FIG. 22(*a*), in the normal state, the lock arm 9 comes into contact with the peripheral surface of the lock shaft 11 opposite to the cutout portion 45. When an opening operation is performed, the lock shaft 11 is rotated by a half turn, so that the lock arm 9 is switched into a state in which the lock arm 9 comes into contact with the cutout portion 45 from a state in which the lock arm 9 comes into contact with the peripheral surface of the lock shaft 11. Accordingly, since a height position where the lock arm 9 and the lock shaft 11 come into contact with each other is moved upward, the lock arm 9 is moved upward by the upward force Fopen. As a result, the rotating unit 3 connected to the lock arm 9 is also rotated upward and the conveying path is opened.

When a closing operation is performed, the lock shaft 11 is further rotated by a half turn, so that the contact position between the lock arm 9 and the lock shaft 11 is changed to the peripheral surface from the cutout portion 45 again. Accordingly, the lock arm 9 is moved downward and the rotating unit 3 is also moved downward. Finally, a state returns to the normal state shown in FIG. 22(*a*) and the conveying path is closed.

Fifth Embodiment

Figure 23:
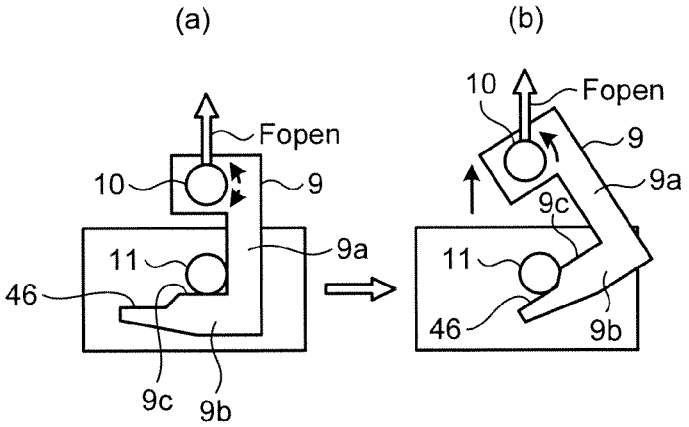
FIG. 23 is a schematic diagram for explaining the structures and the operations of a lock shaft and a lock arm of a fifth embodiment.
Figure 24:
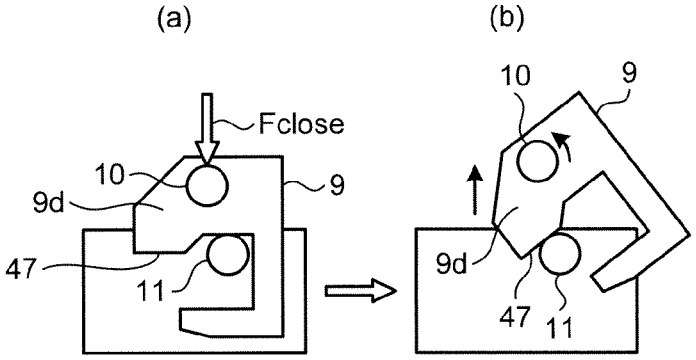
FIG. 24 is a schematic diagram for explaining the structures and the operations of the lock shaft and the lock arm of the fifth embodiment when a downward force is applied to the lock arm.

A fifth embodiment will be explained with reference to FIG. 23 and FIG. 24. FIG. 23 is a schematic diagram for explaining the structures and the operations of a lock shaft and a lock arm of a fifth embodiment, and FIG. 24 is a schematic diagram for explaining the structures and the operations of the lock shaft and the lock arm of the fifth embodiment when a downward force is applied to the lock arm.

As shown in FIG. 23, the fifth embodiment is different from each of the embodiments in that a stepped portion is formed on the engaging claw 9*b* of the lock arm 9 to change the contact position between the lock arm 9 and the lock shaft 11 so that an operation for opening/closing the rotating unit 3 is performed.

As shown in FIG. 23, the engaging claw 9*b* of the lock arm 9 includes a stepped surface 46 formed on a contact surface 9*c* thereof coming into contact with the lock shaft 11. The stepped surface 46 is formed so as to be recessed from the contact surface 9*c* of the engaging claw 9*b* in a direction in which the stepped surface 46 is separated from the lock shaft 11. Further, the stepped surface 46 is formed at the tip portion of the engaging claw 9*b*. Since the engaging claw 9*b* includes the stepped surface 46, the contact surface 9*c* of the engaging claw 9*b* comes into contact with the lock shaft 11 as shown in, for example, FIG. 23(*a*) when the lock arm 9 is deeply rotated toward the lock shaft 11, and the stepped surface 46 formed at the tip portion of the engaging claw 9*b* comes into contact with the lock shaft 11 as shown in FIG. 23(*b*) when the lock arm 9 is separated from the lock shaft 11.

The lock arm 9 is adapted to be rotated when a driving shaft (or a rotating shaft) 10 is driven by a driving source such as a motor. The lock arm 9 can switch a contact portion, which comes into contact with the lock shaft 11, to the contact surface 9*c* or the stepped surface 46 by this rotation.

In a normal state in which the rotating unit 3 is fitted to the fixed unit 4 and the conveying path is closed, the contact surface 9*c* of the engaging claw 9*b* of the lock arm 9 comes into contact with the peripheral surface of the lock shaft 11 as shown in FIG. 23(*a*).

When an opening operation is performed, the lock arm 9 is rotated in a direction in which the arm portion 9*a* is separated from the lock shaft 11 (a counterclockwise direction in FIG. 23) as shown in FIG. 23(*b*). Accordingly, the lock arm 9 is switched into a state in which the stepped surface 46 comes into contact with the lock shaft 11 from a state in which the contact surface 9*c* of the engaging claw 9*b* comes into contact with the peripheral surface of the lock shaft 11. Since the stepped surface 46 is formed so as to be recessed in a direction in which the stepped surface 46 is separated from the lock shaft 11, a distance between the rotating shaft 10 of the lock arm 9 and the lock shaft 11 is increased by an upward force Fopen applied to the lock arm 9. Accordingly, the rotating shaft 10 of the lock arm 9 is separated upward from the lock shaft 11. As a result, the rotating unit 3 connected to the lock arm 9 is also rotated upward and the conveying path is opened.

When a closing operation is performed, the lock arm 9 is rotated in a direction opposite to the direction corresponding to the opening operation (a clockwise direction in FIG. 23). Accordingly, since the contact position between the lock arm 9 and the lock shaft 11 is changed to the contact surface 9*c* from the stepped surface 46, a distance between the rotating shaft 10 of the lock arm 9 and the lock shaft 11 is reduced and the lock arm 9 is moved downward. As a result, the rotating unit 3 is also moved downward. Finally, a state returns to the normal state shown in FIG. 23(*a*) and the conveying path is closed.

Further, the structure in which the force Fopen rotating the rotating unit 3 upward is normally applied to the rotating unit 3 has been exemplified in this embodiment. However, it is also considered that, conversely, a force in a direction in which the rotating unit 3 approaches the fixed unit 4, that is, a force Fclose rotating the rotating unit 3 downward is applied. At this time, a force transmitted to the lock arm 9 is a downward force. In this case, as shown in FIG. 24(*a*), a base portion 9*d* of the lock arm 9 comes into contact with the lock shaft 11 from above and a stepped surface 47 protruding from the base portion 9*d* of the lock arm 9 toward the lock shaft 11 is formed on the base portion 9*d*. According to this structure, when an opening operation is performed, a state is changed to a state in which the stepped surface 47 and the lock shaft 11 come into contact with each other as shown in FIG. 24(*b*), by the rotation of the lock arm 9. Accordingly, the lock arm 9 can be pushed up against a downward force Fclose.

Meanwhile, a structure that changes the position of the rotating unit 3 relative to the fixed unit 4 by the movement of the rotating shaft 10 of the lock arm 9 in a predetermined direction can be used other than the structure of the fifth embodiment that has been explained with reference to FIG. 23 and FIG. 24. For example, for the change of the position of the rotating unit 3 relative to the fixed unit 4, the movement of the lock shaft 11 in the up-and-down direction has been used in the first and second embodiments, the movement of the lock shaft 11 in the axial direction has been used in the third embodiment, and the rotation of the lock shaft 11 about an axis has been used in the fourth embodiment. However, the movable shaft can be substituted with the rotating shaft 10 of the lock arm 9 from the lock shaft 11 in the structures of these embodiments. That is, the position of the rotating unit 3 relative to the fixed unit 4 may be changed by the movement of the rotating shaft 10 of the lock arm 9 in the up-and-down direction, the movement of the rotating shaft 10 in the axial direction, or the rotation of the rotating shaft 10 about an axis.

Sixth Embodiment

Figure 25:
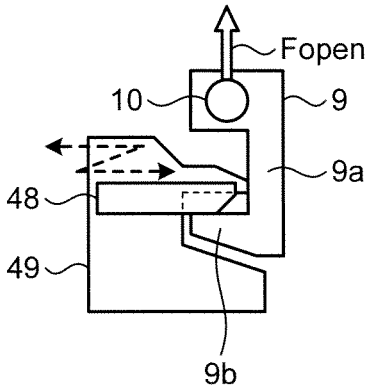
FIG. 25 is a schematic diagram for explaining a structure that positions a lock arm by a frame member of a sixth embodiment.
Figure 26:
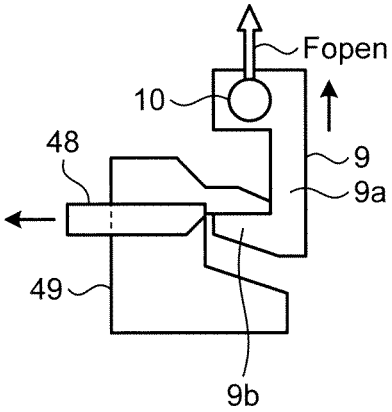
FIG. 26 is a schematic diagram for explaining the operations of the frame member and the lock arm when an opening operation is performed.

A sixth embodiment will be explained with reference to FIGS. 25 and 26. FIG. 25 is a schematic diagram for explaining a structure that positions a lock arm by a frame member of a sixth embodiment, and FIG. 26 is a schematic diagram for explaining the operations of the frame member and the lock arm when an opening operation is performed.

As shown in FIG. 25, the sixth embodiment is different from each of the embodiments in that the lock arm 9 is locked by a frame member 48 movable in a horizontal direction instead of the lock shaft 11 and an operation for opening/closing the rotating unit 3 is performed by the release of the locking of the lock arm 9 performed by the frame member 48.

As shown in FIG. 25, the engaging claw 9*b* is inserted into a fixed frame 49, which is fixed to the fixed unit 4, by the rotation of the lock arm 9 about the rotating shaft 10. Accordingly, the lock arm 9 is locked to the fixed frame 49, so that the upward rotation of the rotating unit 3 is restricted. The frame member 48 can enter an engagement portion between the fixed frame 49 and the engaging claw 9*b* of the lock arm 9 by being moved in the horizontal direction by a driving source such as a motor. The frame member 48 is installed so that the height position of the bottom of the frame member 48 is lower than an engaging portion of the fixed frame 49 when the frame member 48 enters the engagement portion.

In a normal state in which the rotating unit 3 is fitted to the fixed unit 4 and the conveying path is closed, the frame member 48 enters the engagement portion between the fixed frame 49 and the engaging claw 9*b* of the lock arm 9 as shown in FIG. 25. For this reason, the engaging claw 9*b* of the lock arm 9 comes into contact with not the fixed frame 49 but the frame member 48 having entered.

When an opening operation is performed, the frame member 48 is moved in a direction in which the frame member 48 is separated from the engagement portion (to the left side in FIG. 26) as shown in FIG. 26. Accordingly, since a gap is formed above the engaging claw 9*b* of the lock arm 9, the lock arm 9 is moved upward to a position where the engaging claw 9*b* comes into contact with the fixed frame 49, by the upward force Fopen applied to the rotating shaft 10 of the lock arm 9. As a result, the rotating unit 3 connected to the lock arm 9 is also rotated upward and the conveying path is opened.

When a closing operation is performed, the frame member 48 is moved in a direction opposite to the direction corresponding to the opening operation (to the right side in FIG. 26). That is, the frame member 48 approaches the engagement portion between the lock arm 9 and the fixed frame 49, and enters the engagement portion while pushing down the engaging claw 9*b* of the lock arm 9. As a result, the rotating unit 3 is also moved downward while interlocking with the lock arm 9. Finally, a state returns to the normal state shown in FIG. 25 and the conveying path is closed.

The structure in which the separating roller 71 and the conveying roller 81 driven in the conveying direction are disposed in the rotating unit 3 and the braking roller 72 and the driven roller 82 are disposed in the fixed unit 4 has been exemplified in the embodiments, but these rollers may be disposed to the contrary. That is, the separating roller 71 and the conveying roller 81 may be disposed in the fixed unit 4, and the braking roller 72 and the driven roller 82 may be disposed in the rotating unit 3. Further, the separating roller 71 and the conveying roller 81 may be separately disposed in the rotating unit 3 and the fixed unit 4.

Furthermore, the structure in which the lock arm 9 is disposed in the rotating unit 3 and the lock shaft 11 is disposed in the fixed unit 4 has been exemplified in the embodiments, but these elements may be disposed to the contrary. That is, the lock arm 9 may be disposed in the fixed unit 4 and the lock shaft 11 may be disposed in the rotating unit 3.

According to the medium feeding apparatus of the invention, time, which is taken for an opening/closing operation performed before and after recovery work, can be reduced, so that the efficiency of the recovery work at the time of the occurrence of a conveyance error can be improved.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A medium feeding apparatus comprising:

a first member;

a second member;

a first conveying unit that is installed on the first member and conveys a medium present on a conveying path in a conveying direction;

a second conveying unit that is installed on the second member and comes into press contact with the first conveying unit on the conveying path;

a locking member that is installed on the first member;

a receiving member that is installed on the second member and keeps a position of the first member relative to the second member by locking the locking member; and a position changing unit that changes the position of the first member relative to the second member by moving any one of the locking member and the receiving member in a predetermined direction, wherein the locking member includes a lock arm that is adapted to be rotatable in a predetermined direction and is locked to the receiving member by being rotated, the receiving member includes a lock shaft that comes into contact with a locking claw of the lock arm and prevents the first member from being separated from the second member by restricting the movement of the lock arm toward the first member, and the position changing unit changes the position of the first member relative to the second member by the movement of the lock shaft in a predetermined direction.

2. The medium feeding apparatus according to claim 1, further comprising:

a medium loading unit on which the medium is loaded, wherein the medium loading unit is adapted to move in a predetermined direction in case of a conveyance error of the medium and to return to an original position after a completion of recovery work for the conveyance error, and the position changing unit is configured to move the lock shaft in a direction in which the lock shaft approaches the first member by using a force that is applied by the movement of the medium loading unit in the predetermined direction at the time of the occurrence of the conveyance error, and to return the lock shaft to the original position by the movement of the medium loading unit to the original position after the completion of the recovery work.

3. The medium feeding apparatus according to claim 1, wherein the position changing unit includes a driving source, and an interlock unit that moves the lock shaft by the drive of the driving source in a direction in which the lock shaft approaches or is separated from the first member.

4. The medium feeding apparatus according to claim 1, wherein the lock shaft includes a cutout portion formed thereon, and the position changing unit is configured to move the lock shaft in a direction in which the lock shaft approaches the first member at the time of the occurrence of the conveyance error by moving the lock shaft in an axial direction so that the locking claw of the lock arm comes into contact with the cutout portion.

5. The medium feeding apparatus according to claim 1, wherein the lock shaft includes a cutout portion formed thereon, and the position changing unit is configured to move the lock shaft in a direction in which the lock shaft approaches the first member at the time of the occurrence of the conveyance error by rotating the lock shaft about an axis so that the locking claw of the lock arm comes into contact with the cutout portion.

* * * * *